US006302555B1

(12) United States Patent
Bristow

(10) Patent No.: US 6,302,555 B1
(45) Date of Patent: Oct. 16, 2001

(54) APPARATUS FOR SIMULATING FLAMES

(75) Inventor: Gary Bristow, Cheshire (GB)

(73) Assignee: Burley Appliances Limited (GB)

( * ) Notice: Subject to any disclaimer, the term of this patent is extended or adjusted under 35 U.S.C. 154(b) by 0 days.

(21) Appl. No.: 09/424,799

(22) PCT Filed: May 27, 1998

(86) PCT No.: PCT/GB98/01530

§ 371 Date: Feb. 1, 2000

§ 102(e) Date: Feb. 1, 2000

(87) PCT Pub. No.: WO98/54516

PCT Pub. Date: Dec. 3, 1998

(30) Foreign Application Priority Data

May 31, 1997 (GB) ..... 9711185

(51) Int. Cl.[7] ..... F21V 33/00

(52) U.S. Cl. ..... 362/96; 362/806; 362/253; 40/428

(58) Field of Search ..... 362/96, 294, 806, 362/253; 40/428, 436, 439; 392/348; 472/65

(56) References Cited

U.S. PATENT DOCUMENTS

| | | | | |
|---|---|---|---|---|
| 3,395,475 | * | 8/1968 | Moss | 40/428 |
| 3,603,013 | * | 9/1971 | Reed et al. | 40/106.54 |
| 4,965,707 | | 10/1990 | Butterfield . | |
| 5,642,580 | | 7/1997 | Hess et al. . | |
| 6,047,489 | | 4/2000 | Hess et al. . | |

FOREIGN PATENT DOCUMENTS

WO 97/41393 11/1997 (WO) .

* cited by examiner

*Primary Examiner*—Y. Quach
(74) *Attorney, Agent, or Firm*—Kirschstein, et al.

(57) ABSTRACT

Apparatus for simulating flames, comprising a source of light, a reflector, a screen, and a flame effect member located between the reflector and the screen. The flame effect member preferably comprises a sheet of flexible fabric, provided with a plurality of slits, such that air from a fan causes the sheet to billow, alternately opening and closing the slits. Light transmitted from the source towards the flame effect member passes through the openings and falls onto the screen as an area of high intensity light, which as the sheet billows, appears to move upwardly, simulating the appearance of a flickering flame.

14 Claims, 2 Drawing Sheets

APPARATUS FOR SIMULATING FLAMES

BACKGROUND OF THE INVENTION

Figure 1:
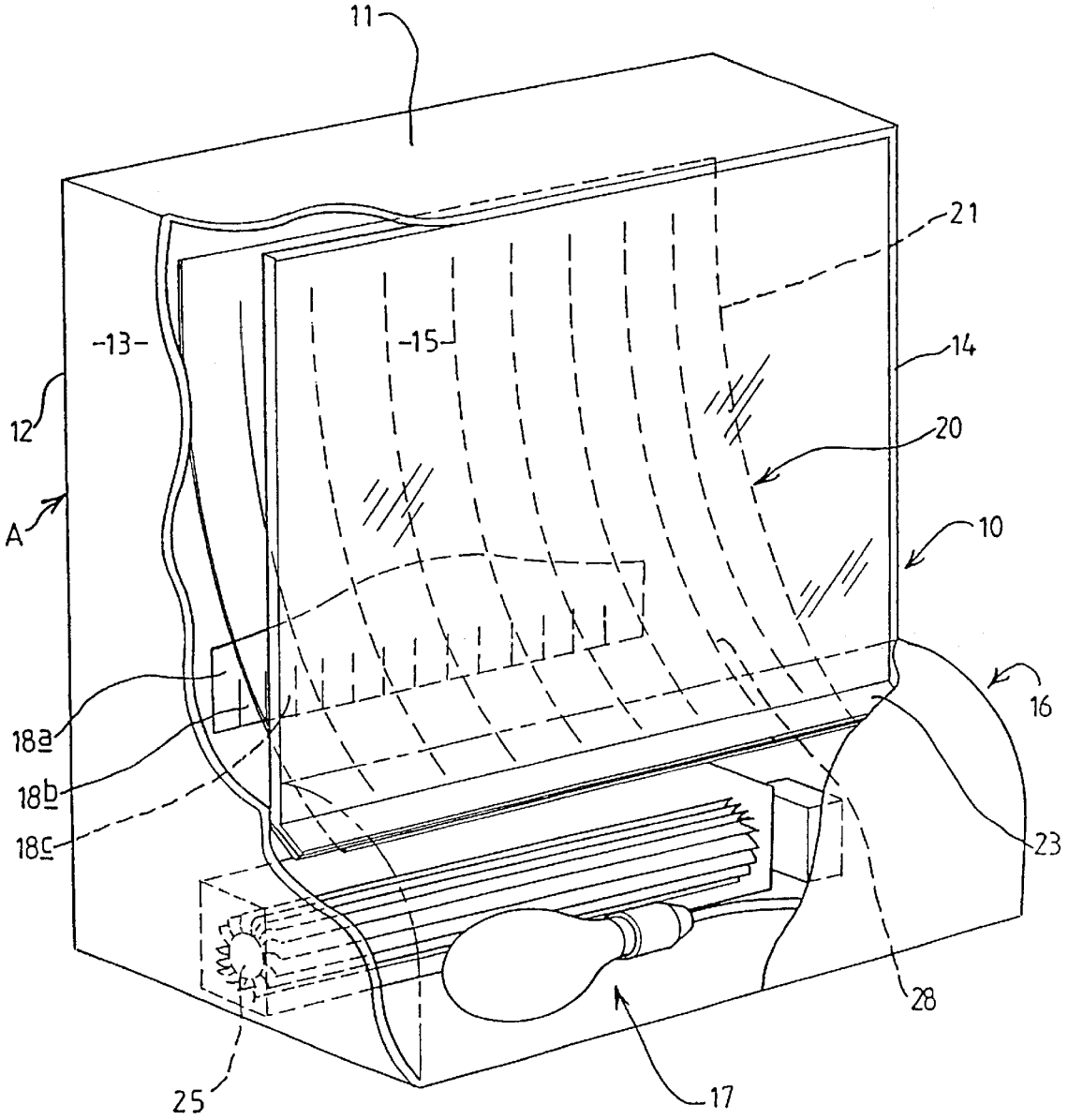

This invention relates to apparatus for simulating flames, and particularly but not exclusively to apparatus for simulating flames in a solid fuel effect fire, to give the impression of flames emanating from combustion fuel.

Several arrangements have hitherto been used to simulate flames in such fires, the most common of which in recent years utilizing a plurality of reflective ribbons or strips suspended adjacent to a rear part of the fire, a light source located forwardly of the ribbons or strips, and a translucent screen also located forwardly of the ribbons or strips such that light from the light source reflected from the ribbons or strips is incident on a rear surface of the screen, giving a flame effect when the screen is viewed from the front. Such an arrangement shown in GB-A-968568.

To give the impression of flames, the ribbons or strips are generally movable, such as by a current of air produced from a fan located within the body of the fire, and may additionally or alternatively be colored or shaped so as to improve the flame effect produced.

Additionally, it is known from GB-A-1186655 to suspend the strips in front of the light source, so that light is transmitted between the strips and onto the translucent screen.

Notwithstanding the attention which has been given to the development of an apparatus for simulating flames as shown in the extensive prior art, heretofore all suggestions which have been made have been lacking in realism, and it is an object of the present invention to provide an improved apparatus for simulating flames.

SUMMARY OF THE INVENTION

According to one aspect of the invention, there is provided apparatus for simulating flames comprising the light source, a screen, and a flame effect member located optically between the light source and the screen, effect or means being provided to cause openings to be produced in the flame effect member, appearing as areas of light on the screen, and to cause the openings to move such that the areas of light appear to move upwardly.

Thus, by the use of a translucent screen through which the flame effect member is in conventional manner viewed from a position in front of the apparatus, the visual effect which is produced is one in which the areas of light appear as flames on the screen, moving upwardly in the expected manner.

Preferably the flame effect member is also translucent, and light also falls onto the screen having passed through the flame effect member.

In this manner, for example, where the light which passes through the flame effect member and falls onto the screen is colored yellow or orange, an appearance may be achieved which is similar to the glow of real fire with portions of whiter light, having passed through the openings in the flame effect member, producing the appearance of the flames.

Conveniently, the flame effect member comprises a sheet of flexible material provided with a plurality of elongate slits.

The slits may be afforded by narrow apertures, typically having a width less than 2 mm, but are preferably provided by cuts provided in the flexible material, whereby a more appropriate opening and closing of the slits may be effected.

The effector means may cause movement of the flame effect member by direct contact, but the effector means is preferably operative to generate and to direct against the sheet of flexible material a flow of air to cause the sheet to flex and the slits to open and close.

Thus, the flame effect member conveniently comprises a sheet of fabric suspended at an upper end portion, and secured loosely at a lower end portion, the flow of air causing the sheet of fabric to "billow" and as the billowing in the sheet moves upwardly, there is produced an opening of the slits which also travels generally upwardly.

Any convenient fabric may be utilized, such as nylon or silk, but it has been found that Crepe de Chine is particularly suitable.

Thus, preferably the sheet of fabric is secured at an upper end portion adjacent to a rear wall of the housing of the apparatus, and the lower end portion is secured adjacent to the screen, preferably in a manner such that some draping of the fabrics takes place.

Preferably the apertures are provided by a plurality of elongate slits which may be provided at intervals typically in the region of 3 cm to 6 cm, the slits conveniently extending the majority of the full height of the sheet of fabric. If desired the slits may fan out in the upward direction.

Thus preferably the sheet of fabric is suspended at its lower end portion adjacent to the bottom of the screen.

Thus preferably the fan is located below, and slightly rearwardly of the forward edge portion of the flame effect member, the fan being operative to generate a current of air to cause the flame effect means to move in a billowing-type manner as described above. Thus, as the deformation produced in the sheet moves upwardly away from the far, the extent of the deformation is reduced, reducing the size of the openings and thus the size of the areas of light falling onto the screen.

Preferably the apparatus comprises reflector means from which light is reflected from the light source through the flame effect member onto the screen.

The reflector preferably comprises a reflective strip adhesively attached to the rear wall of the housing, and the reflector may be removable from the rear wall. However, the reflector may be fixed in any convenient manner, and possibly, may be fixed to side walls of the fire.

The reflector, in front elevation, may be configured so as to conform generally with the shape of flames. Thus, the height of the reflector may increase towards a middle portion thereof.

The reflector may be formed from a foil, such as aluminum foil, or a plastics substrate having a metallic finish, but it will be appreciated that a wide variety of reflective materials may be used.

The reflector may additionally be colored, for example red, yellow and/or orange, such that the light reflected therefrom onto the screen provides a realistic flame color.

The reflector may be generally of one or multi-piece construction, but conveniently, the reflector comprises a plurality of parts movable relative to each other, such as for example, a plurality of generally vertically extending strips, and preferably the fan is operative to generate a current of air directed towards the reflector, such that pars of the reflector may also be caused to move, such that the light reflected therefrom "flickers" adding to the realism of the flame effect.

The screen may be formed from either transparent or translucent material, such as glass or plastics. In order to provide a diffuse effect, either or both surfaces of the screen may be treated or etched, or alternatively, an additional sheet or sheets of glass or plastics material may be provided to distort or blur the image projected onto the screen by the light source/reflector arrangement.

Additionally, the screen and/or the additional sheet may be colored or shaded if desired.

The source of light may emit so called "white light" as is used in household lamp bulbs, but preferably, the light may be colored, either by use of a coloured bulb or by the use of appropriately colored filters.

According to this invention there is also provided apparatus for simulating flames comprising:

(a) a housing having a front provided by a screen:

(b) a flame effect member located in the housing, said flame effect member being of flexible sheet material suspended from an upper end secured to the housing and being secured at a lower end such that the flame effect member extends upwardly and away from the screen, the flame effect member being provided with a plurality of openings or slits extending generally in the upward direction;

(c) a light source from which light is directed through the flame effect member onto the screen; and (d) means to direct a flow of air against a rear face of the flame effect member.

BRIEF DESCRIPTION OF THE PREFERRED EMBODIMENTS

Figure 2:
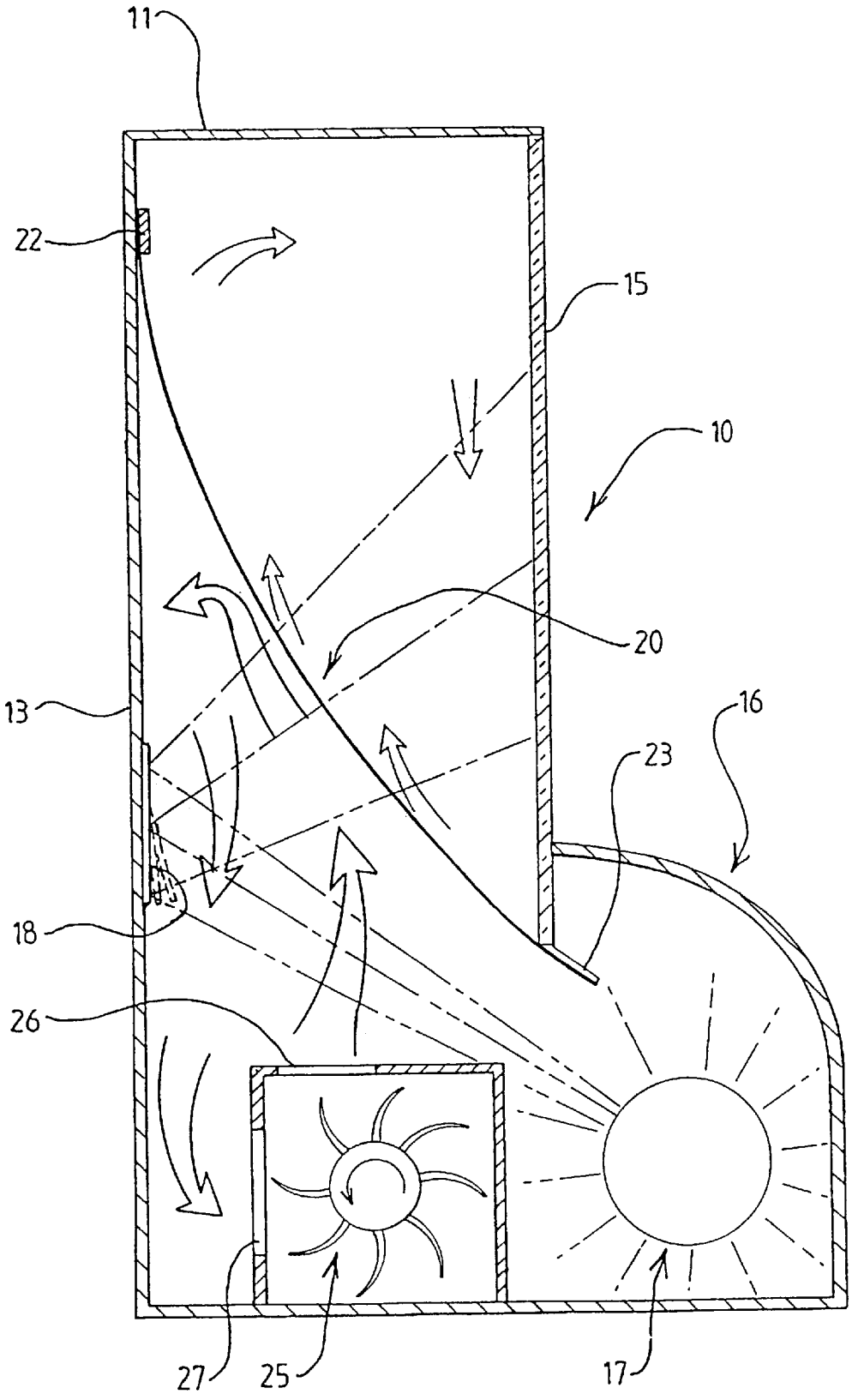

The invention will now be described in greater detail by way of example only, by reference to the accompanying drawings, wherein FIG. 1 is a perspective and partly cut away view of the invention, incorporated in a solid fuel effect fire, and FIG. 2 is a side view of the embodiments shown in FIG. 1, viewed in the direction indicated by the arrow A.

DETAIL DESCRIPTION OF THE PREFERRED EMBODIMENTS

Referring to the drawings, a simulated fire 10 comprises a body 11 having a rear walls 12, and side walls 13 and 14, together with a space heating element (not shown).

In conventional manner, the fire comprises a translucent plastics screen 15, which may provide a front wall of the body.

Towards a lower part of the body there is provided a forwardly extending section generally indicated at 16, on which may be provided imitation logs, coals or the like, although these are not shown in the drawings.

Located within the section 16 is a light source 17, which may project light through the imitation logs or coals, conveniently via the intermediary of colored filters or the like and which also projects light to a reflector 18 provided on the rear wall 12 of the body.

The light source conveniently produces generally "white" light, such as is produced from conventional household bulbs.

The reflector comprises a sheet of foil adhered to the rear wall of the housing such as with adhesive and is provided with vertical cuts, as shown, to afford a plurality of strips, as indicated for example at 18*a*, 18*b*, and 18*c*, the strips conveniently being movable relative to each other.

In this manner, lower parts of the strips may flex away from the rear wall, as shown in FIG. 2 in dotted outline.

The apparatus further comprises flame effect means 20, in the form of a sheet of translucent material 21, which conveniently is Crepe de Chine, desirably colored red.

The flame effect means is held in position relative to the body by means of supports 22 and 23, secured to the rear wall of the body which extend generally the full width of the body, and which may be engaged with side walls 13 and 14 by spot welding.

From FIG. 2, it will be noted that the light source is located generally forwardly of the screen 15, the support 23 acting as a shield, such that only light reflected from the reflector 18 is able to fall onto the screen.

This enables "non-colored" lamps to be used, since the light which is incident on the rear surface of the flame effect means may be colored by use of a colored reflector 18.

A fan 25 is located generally towards the rear and the base of the body, the fan comprising a plurality of vanes extending widthwise of the body, so as to generate a current of air moving generally up the body, from aperture 26 of the fan housing, and to re-enter the fan housing via aperture 27, as illustrated schematically by the arrows in FIG. 2.

The current of air is operative to cause the strips to the reflector to flutter, and is also operative to cause the flame effect sheet 21 to billow, which billowing movement opens and closes slits 28 in the sheet.

The effect of movement of the reflector strips, and the flame effect sheet 21, is that the light from the light source which is incident on area surface of the screen 15, creates a simulated flame effect, which is considerably more realistic than those which have previously been provided.

The applicants have found that as the flame effect sheet 21 billows, the slits 28 open to produce a plurality of areas through which light falls onto the screen without passing through the material of the flame effect member. In this way, small patches of higher intensity light are viewed on the screen, and as the fabric billows upwardly, the openings provided within the slits 28 also move upwardly, causing the areas of transmitted light to move upwardly in a non-regular manner, and as such imitate movement of an upwardly moving flame.

While FIGS. 1 and 2 illustrate a preferred embodiment of the invention, in which light is reflected onto a rear surface of the flame effect means, the applicants have found that a satisfactory flame imitation effect may in fact be achieved by lighting the flame effect means directly from a light source, without the intermediary of a reflector.

Thus, there may be provided a light source housing towards the rear of the apparatus, conveniently in the region which would otherwise be occupied by the reflector, from which light may project to the rear surface of the flame effect means.

Whereas with the reflector it is of course possible to color the light by using appropriately colored reflective strips, in the alternative embodiment it may be convenient to either use a colored lamp bulb or to surround the light source with appropriately colored filters.

It will be appreciated that with such an arrangement, the flame effect means preferably comprises one or more of the features as described in relation to the figures, and foregoing description.

The apparatus as above described provides advantages over those previously known, in that not only is a superior flame effect provided, but also, should it be desired to vary the effect, replacement of the flame effect sheet is facilitated since it is generally of one piece construction, such that removal thereof only requires the supports 22 and 23 to be removed, rather than the replacement of a plurality of individual ribbons as has hitherto been the case.

Furthermore, manufacture of the flame effect means is considerably facilitated since it merely requires slits to be cut within a sheet of material, rather than the manufacture of several individual ribbons as has hitherto been the case.

The features disclosed in the foregoing description, or the accompanying drawings, expressed in their specific forms or in terms of a means for performing the disclosed function, or a method or process for attaining the disclosed result or a class or group of substances or compositions as appropriate, may, separately or in any combination of such features, be utilized for realizing the invention in diverse forms thereof.

What is claimed is:

1. An apparatus for simulating flames, forming part of a simulated fire, comprising:

a) a housing having a source of light;

b) the housing having screen means;

c) flame effect means located optically between the source of light and the screen means such that light traveling from the source to the screen means passes through the flame effect means;

d) means for generating a current of air; and e) the flame effect means comprising a sheet of material having therein a plurality of elongate slits which are caused to open and close by the current of air in a manner whereby parts of the material which are disposed either side of each slit are caused intermittently to come into contact with one another.

2. The apparatus according to claim 1, wherein the sheet is draped within the housing to facilitate opening and closing of the slits by the current of air.

3. The apparatus according to claim 1, wherein the upper and lower ends of the flame effect means do not lie in a common vertical plane.

4. The apparatus according to claim 3, wherein the upper end of the flame effect means is supported more rearwardly within the housing that the lower end.

5. The apparatus according to claim 1, wherein the slits are substantially straight.

6. The apparatus according to claim 1, wherein each slit lies within a substantially vertical plane, the planes being substantially parallel to one another.

7. The apparatus according to claim 1, wherein the length of the slits is substantially equal to the height of the sheet.

8. The apparatus according to claim 1, wherein the material in which the slits are provided is translucent, whereby light passing through the slits is incident on the screen means at a first intensity, whereas light passing through the material is incident on the screen means at a second, lower, intensity.

9. The apparatus according to claim 1, wherein the source of light produces generally white light.

10. The apparatus according to claim 1, wherein the sheet of material is colored red or orange.

11. The apparatus according to claim 1, wherein a reflector is disposed optically between the source of light and the flame effect means, the reflector comprising a plurality of parts movable relative to each other.

12. The apparatus according to claim 11, wherein the reflector comprises a plurality of substantially vertically extending strips.

13. The apparatus according to claim 11, wherein the current of air causes the plurality of parts to move, whereby the light reflected therefrom flickers.

14. A simulated fire having a housing provided by side and rear housing walls, and an apparatus for simulating flames within the housing, the apparatus comprising:

a) a source of light;

b) screen means;

c) flame effect means located optically between the source of light and the screen means such that light traveling from the source to the screen means passes through the flame effect means;

d) means for generating a current of air; and e) the flame effect means comprising a sheet of material having therein a plurality of substantially elongate slits which are caused to open and close by the current of air in a manner whereby parts of the material which are disposed either side of each slit are caused intermittently to come into contact with one another.

* * * * *